US012460656B1

(12) United States Patent
Tseng et al.

(10) Patent No.: US 12,460,656 B1
(45) Date of Patent: Nov. 4, 2025

(54) PRESS TYPE ASSEMBLED FAN

(71) Applicant: Dongguan City Think-cool Thermal Dissipation Technologies Co., Ltd, Dongguan (CN)

(72) Inventors: Chihchun Tseng, Dongguan (CN); Chengchien Wang, Dongguan (CN)

(73) Assignee: Dongguan City Think-cool Thermal Dissipation Technologies Co., Ltd, Dongguan (CN)

( * ) Notice: Subject to any disclaimer, the term of this patent is extended or adjusted under 35 U.S.C. 154(b) by 0 days.

(21) Appl. No.: 18/769,193

(22) Filed: Jul. 10, 2024

(51) Int. Cl.
*F04D 29/52* (2006.01)
*F04D 25/06* (2006.01)

(52) U.S. Cl.
CPC ..... *F04D 29/522* (2013.01); *F04D 25/06* (2013.01)

(58) Field of Classification Search
CPC ..... F04D 19/002; F04D 25/0613; F04D 25/0693; F04D 25/08; F04D 25/166
See application file for complete search history.

(56) References Cited

U.S. PATENT DOCUMENTS 10,690,336 B1 * 6/2020 Chen ..... G06F 1/20

FOREIGN PATENT DOCUMENTS

| | | | |
|---|---|---|---|
| CN | 214837258 U | | 11/2021 |
| CN | 219035064 U | * | 5/2023 |
| TW | I874020 B | * | 2/2025 |

* cited by examiner

*Primary Examiner* — Essama Omgba
*Assistant Examiner* — Joseph S. Herrmann
(74) *Attorney, Agent, or Firm* — Birchwood IP

(57) ABSTRACT

A press type assembled fan is provided. The fan includes a frame and fan blades installed on the frame. One side of the frame is provided with a first electrical connector and slidably provided with a first push plate, an outer end face of the first push plate is rotatably connected with a fastener; the other side of the frame is provided with a second electrical connector and slidably provided with a second push plate. The second push plate is provided with a buckle corresponding to the fastener, the fastener is configured to detachably connect with the buckle; when the push plate slides along one side of the frame, the first fastener rotates along the push plate. This press type assembled fan is provided to solve a problem of poor assembly stability of fans in the existing technology during use.

4 Claims, 5 Drawing Sheets

PRESS TYPE ASSEMBLED FAN

TECHNICAL FIELD

The present disclosure relates to the field of heat sink technologies, and in particular, to a press type assembled fan.

BACKGROUND

With a continuous development of computer technology, personal computers are gradually entering households and becoming an indispensable and important component of people's daily lives. And personal computers have gradually evolved from customized machines from major brand manufacturers to DIY being the mainstream; nowadays, people's economic conditions also allow them to upgrade their personal computers, and there are gradually emerging DIY enthusiasts like hardware enthusiasts.

Water cooling is also a commonly used accessory in computer hardware DIY, which is generally divided into integrated water cooling or split water cooling. Compared to split type water cooling, the integrated water cooling has a lower cost and is also the water-cooling type with the highest installed capacity. The integrated water cooling generally consists of a cold exhaust, a fan, a water pipe, and a cold head, and the fan is installed on the cold exhaust and dissipates heat from the coolant flowing through the cold exhaust. For large-sized (240 mm or 360 mm) water-cooling systems, the commonly used method on the market is to connect two or three fans with a standard size (120 mm) to assemble. For example, the utility model patent with application number of CN202121126482.7 and titled with a magnetic suction fan set, a magnetic suction is used for connection. As the fans are connected by the magnetic suction, fixed parts are required to limit a horizontal position of the fans. However, due to the small force of the magnetic suction, this type of fan has a problem of poor assembly stability during use.

SUMMARY

In order to overcome the shortcomings and deficiencies in the existing technology, the purpose of the present disclosure is to provide a press type assembled fan, which solves a problem of poor assembly stability of fans in the existing technology during use.

The present disclosure is implemented through the following technical solutions.

A press type assembled fan, including a frame and fan blades installed on the frame, where one side of the frame is provided with a first electrical connector and slidably provided with a first push plate, an outer end face of the first push plate is rotatably connected with a fastener; the other side of the frame is provided with a second electrical connector and slidably provided with a second push plate; the second push plate is provided with a buckle corresponding to the fastener, the fastener is configured to detachably connect with the buckle; when the push plate slides along one side of the frame, the first fastener rotates along the push plate.

In an embodiment of the present disclosure, the outer end face of the first push plate is provided with a rack, the fastener is provided with a gear, and the gear meshes with the rack.

In an embodiment of the present disclosure, the outer end face of the first push plate is further provided with a protrusion, and one side of the frame is provided with a first through-hole configured to expose the protrusion and a second through-hole configured to expose the fastener.

In an embodiment of the present disclosure, one side of the frame is provided with a first recess, and the other side of the frame is provided with a second recess; the first electrical connector is provided in the first recess, and the second electrical connector is provided in the second recess.

In an embodiment of the present disclosure, one side of the second push plate that protrudes from the frame is provided with a button.

In an embodiment of the present disclosure, an elastic member is connected between the second push plate and the frame.

The present disclosure further discloses a fan set, which includes multiple fans as described above. Adjacent fans are detachably connected through the fastener and buckle, and electrically connected through the first electrical connector and the second electrical connector.

In an embodiment of the present disclosure, the fan set further includes a protective shell, which can be detachably connected to the other side of the outermost fan.

The beneficial effects of the present disclosure:

The present disclosure relates to a press type assembled fan, in which adjacent fans are detachably connected through a cooperation between a fastener and a buckle. After the cooperation of the fastener and the buckle, the first electrical connector contacts the second electrical connector to achieve an electrical connection. Compared with the assembly ways of existing technologies, the present disclosure is easier to assemble and has higher assembly stability.

BRIEF DESCRIPTION OF DRAWINGS

Further explanation of the present disclosure is provided with the accompanying drawings, but the embodiments in the drawings do not constitute any limitation on the present disclosure. For those skilled in the art, other drawings can be obtained based on the following drawings without creative work.

Figure 1:
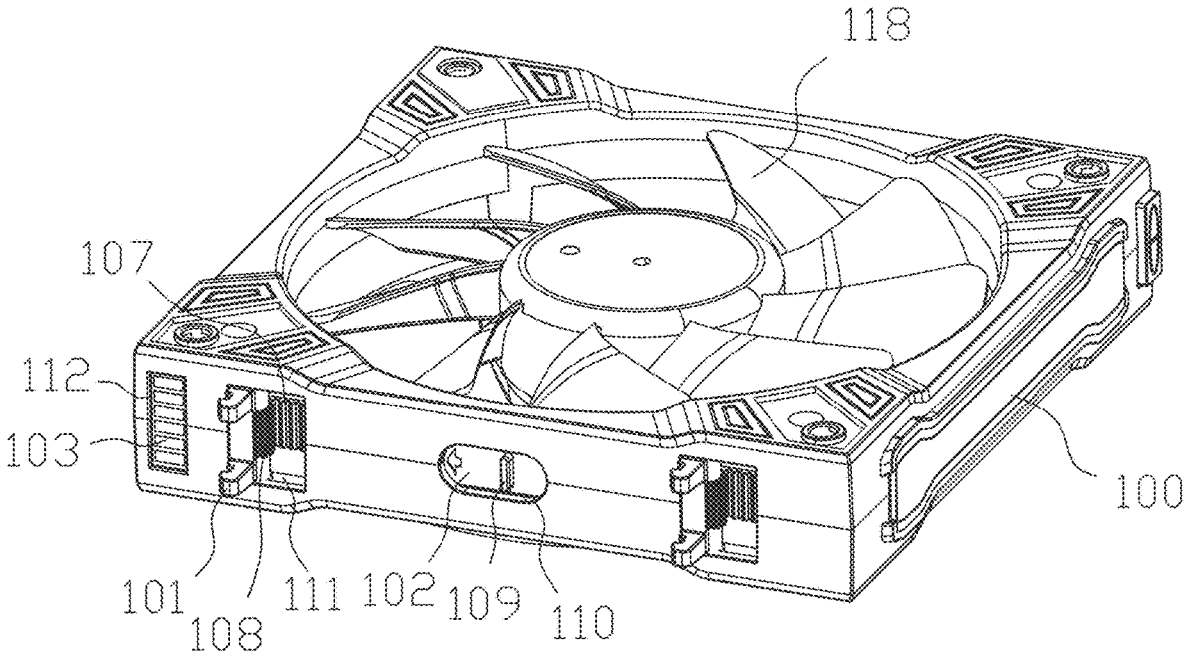
FIG. 1 is a schematic diagram of a three-dimensional structure of a fan.

Numeral reference: frame—100, fastener—101, first push plate—102, first electrical connector—103, buckle—104, second push plate—105, second electrical connector—106, rack—107, gear—108, protrusion—109, first through-hole—110, second through-hole—111, first recess —112, second recess—113, button—114, elastic member—115, protective shell—116, shrapnel—117, fan blade—118.

DESCRIPTION OF EMBODIMENTS

In order to render the above objectives, features, and advantages of the present disclosure more obvious and easier to understand, a detailed explanation of the specific embodiments of the present disclosure will be provided below in combination with the accompanying drawings. Many specific details are elaborated in the following description to facilitate a full understanding of the present disclosure. However, the present disclosure can be implemented in many ways different from the other described herein, and those skilled in the art can make similar improvements without violating the scope of the present disclosure. Therefore, the present disclosure is not limited by the specific embodiments disclosed below.

In a description of the present disclosure, it should be understood that terms "center", "vertical", "transverse", "length", "width", "thickness", "top", "bottom", "front", "back", "left", "right", "vertical", "horizontal", "top", "bottom", "inside", "outside", "clockwise", "counterclockwise", "axial", "radial", "circumferential", etc. indicate an orientation or position relationship based on the orientation or position relationship shown in the drawings, only for a convenience of describing the present disclosure and simplifying the description, and not to indicate or imply the device referred to. Or the member must have a specific orientation, be constructed and operated in a specific orientation, and therefore cannot be understood as a limitation on the present disclosure.

In addition, terms "first" and "second" are only used to describe the purpose and cannot be understood as indicating or implying a relative importance or implying the quantity of technical features indicated. Therefore, the features limited to "first" and "second" can explicitly or implicitly include at least one of these features. In the description of the present disclosure, "a plurality of" means at least two, such as two, three, etc., unless otherwise specified.

With a continuous development of computer technology, personal computers are gradually entering households and becoming an indispensable and important component of people's daily lives. And personal computers have gradually evolved from customized machines from major brand manufacturers to DIY being the mainstream; nowadays, people's economic conditions also allow them to upgrade their personal computers, and there are gradually emerging DIY enthusiasts like hardware enthusiasts.

Water cooling is also a commonly used accessory in computer hardware DIY, which is generally divided into integrated water cooling or split water cooling. Compared to split type water cooling, the integrated water cooling has a lower cost and is also the water-cooling type with the highest installed capacity. The integrated water cooling generally consists of a cold exhaust, a fan, a water pipe, and a cold head, and the fan is installed on the cold exhaust and dissipates heat from the coolant flowing through the cold exhaust. For large-sized (240 mm or 360 mm) water-cooling systems, the commonly used method on the market is to connect two or three fans with a standard size (120 mm) to assemble. For example, the utility model patent with application number of CN202121126482.7 and titled with a magnetic suction fan set, a magnetic suction is used for connection. As the fans are connected by the magnetic suction, fixed parts are required to limit a horizontal position of the fans. However, due to the small force of the magnetic suction, this type of fan has a problem of poor assembly stability during use.

Figure 2:
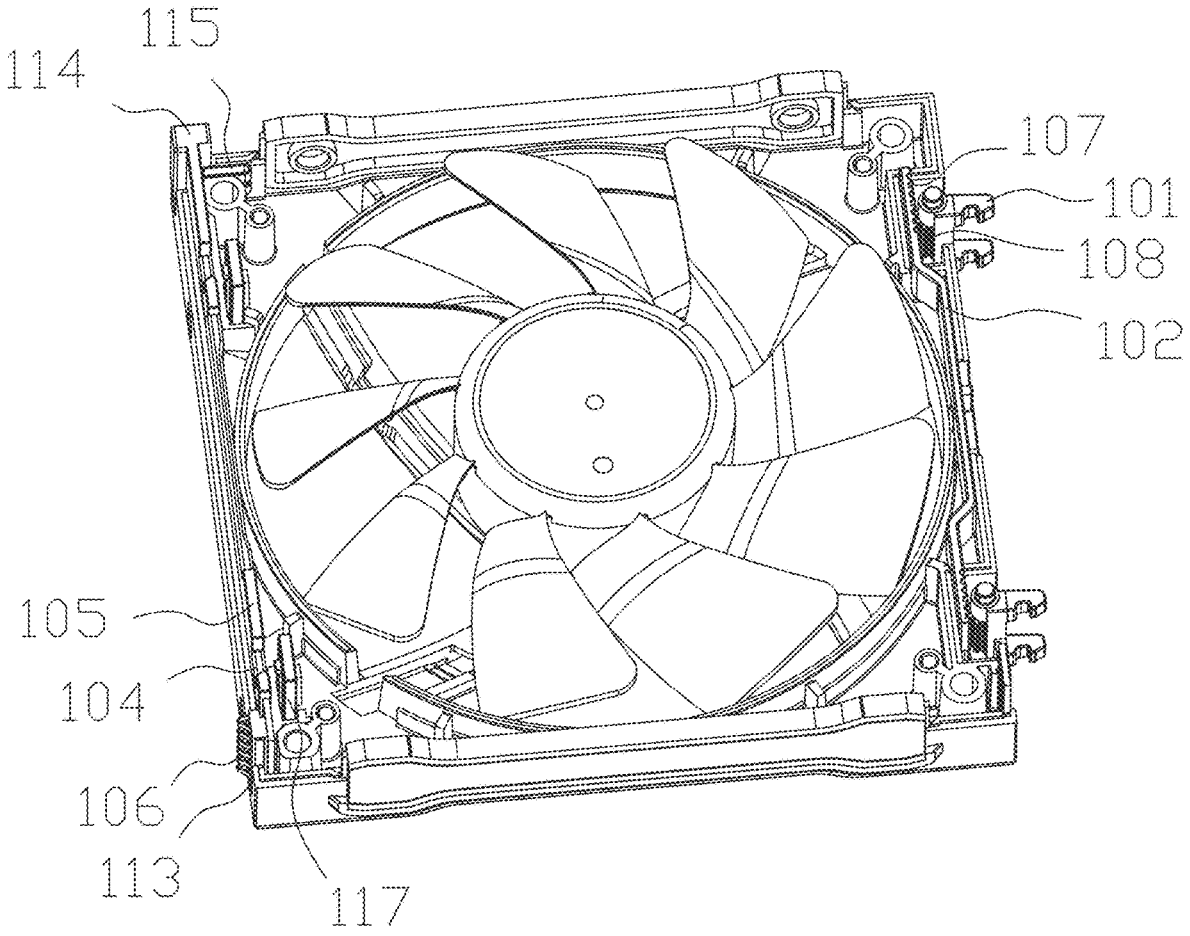
FIG. 2 is a schematic diagram of an internal structure of the fan.

In order to solve the above problems, an embodiment discloses a press type assembled fan, as shown in FIGS. 1 and 2. The fan includes a frame 100 and fan blades 118 installed on the frame 100. One side of the frame 100 is provided with a first electrical connector 103 and slidably provided with a first push plate 102, an outer end face of the first push plate 102 is rotatably connected with a fastener 101; the other side of the frame 100 is provided with a second electrical connector 106 and slidably provided with a second push plate 105. The second push plate 105 is provided with a buckle 104 corresponding to the fastener 101, the fastener 101 is configured to detachably connect to the buckle 104; when the push plate slides along one side of the frame 100, the first fastener 101 rotates along the push plate.

In an implementation, the first electrical connector 103 is an electrical contact piece, and the second electrical connector 106 is a Pin needle or an electrical contact elastic piece; the first push plate 102 is pushed to cause the fastener 101 rotates and protrudes from the frame 100. One side of the fan is aligned with and inserted into the other side of another fan to achieve a fit between the fastener 101 and the buckle 104. The structure of the fastener 101 and buckle 104 can be referred to FIGS. 1 and 2. In an implementation, the fastener 101 and buckle 104 are clamp connection, and a shrapnel 117 is provided on an inner side of the frame 100 near the buckle 104. After the fastener 101 is clamped with the buckle 104, the shrapnel 117 abuts against the fastener 101 to improve a stability of a cooperation between the fastener 101 and buckle 104.

In an implementation, an outer end face of the first push plate 102 is provided with a rack 107, the fastener 101 is provided with a gear 108, and the gear 108 meshes with the rack 107. When the first push plate 102 is pushed, the rack 107 drives the gear 108 to rotate, thereby achieving an effect of driving the fastener 101 to rotate.

In an implementation, the outer end face of the first push plate 102 is further provided with a protrusion 109, and one side of the frame 100 is provided with a first through-hole 110 configured to expose the protrusion 109 and a second through-hole 111 configured to expose the fastener 101. By moving the protrusion 109, the first push plate 102 can be controlled to slide left and right within the frame 100.

In an implementation, one side of the frame 100 is provided with a first recess 112, and the other side of the frame 100 is provided with a second recess 113. The first electrical connector 103 is provided in the first recess 112, and the second electrical connector 106 is provided in the second recess 113. Through the above structure, an embedded structure design of the first electrical connector 103 and the second electrical connector 106 is achieved.

Figure 3:
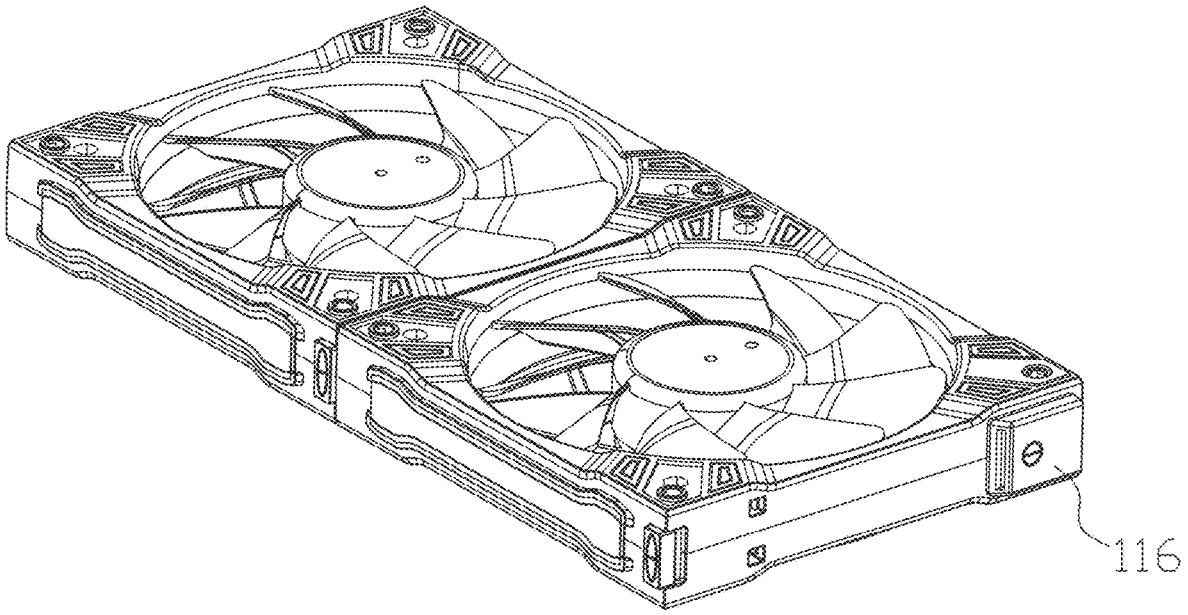
FIG. 3 is a schematic structural diagram of a fan set.
Figure 4:
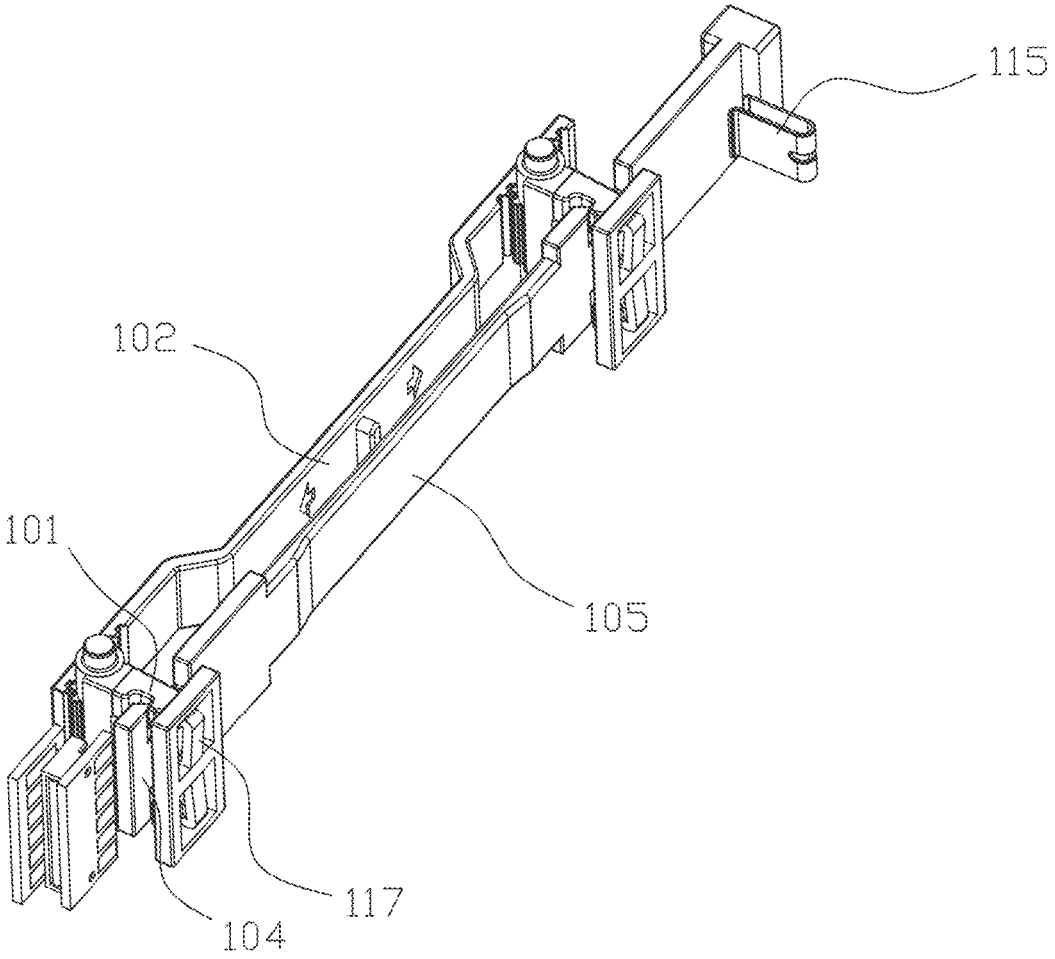
FIG. 4 is a schematic diagram of a partial structure of the fan set.
Figure 5:
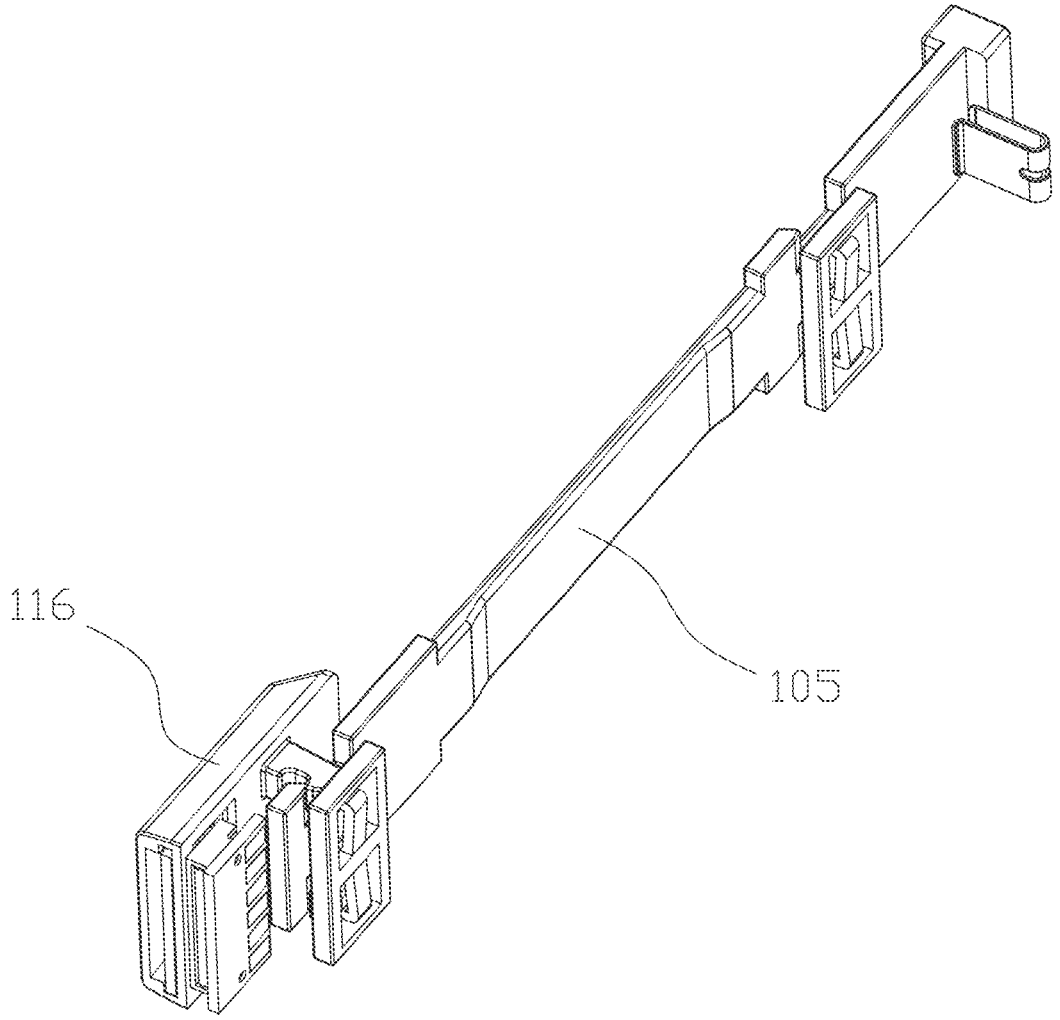
FIG. 5 is a schematic diagram of another part of the fan set.

This embodiment further discloses a fan set, and the structure is shown in FIGS. 3 to 5. The fan set includes a plurality of fans, adjacent fans are detachably connected through the fastener 101 and the buckle 104, and electrically connected through the first electrical connector 103 and the second electrical connector 106.

In an implementation, one side of the second push plate 105 that is protruded from the frame 100 is provided with a button 114. After the gear fastener 101 is matched with the buckle 104, the second push plate 105 is pushed by pressing the button 114 so as to separate the buckle 104 from the fastener 101, thereby achieving a separation between adjacent fans. In addition, an elastic member 115 is connected between the second push plate 105 and the frame 100, which can be reset after pressing the second push plate 105, rendering it convenient for next use.

In an implementation, the fan set further includes a protective shell 116, which can be detachably connected to the other side of the outermost fan. From FIG. 3, it can be seen that due to a portion of the second electrical connector 106 protruding from the frame 100, the protective shell 116 can cover the second connector of the outermost fan, thereby playing a role in protecting the second electrical connector 106.

In summary, the press type assembled fan in this embodiment, adjacent fans are detachably connected through a cooperation between the fastener 101 and buckle 104. After the fastener 101 and the buckle 104 are corporate, the first electrical connector 103 contacts the second electrical connector 106 to achieve an electrical connection; besides, by pressing the first push plate 102, the rotation and folding of the fastener 101 can be achieved, rendering the fan more suitable for individual use or storage. Compared with the assembly ways of existing technologies, the present disclosure is easier to assemble, has higher assembly stability, and will not be inconvenient to store due to the fastener 101 that is protruded.

Finally, it should be noted that the above embodiments are only used to illustrate the technical solution of the present disclosure, and not to limit the protection scope of the present disclosure. Although detailed explanations of the present disclosure have been provided with reference to preferred embodiments, those skilled in the art should understand that modifications or equivalent replacements can be made to the technical solution of the present disclosure without departing from the essence and scope of the technical solution of the present disclosure.

What is claimed is:

1. A press type assembled fan, comprising a frame and fan blades installed in the frame, wherein one side of the frame is provided with a first electrical connector and slidably provided with a first push plate, an outer end face of the first push plate is rotatably connected with a fastener;

the other side of the frame is provided with a second electrical connector and slidably provided with a second push plate; the second push plate is provided with a buckle corresponding to the fastener, the fastener is configured to detachably connect with the buckle;

when the first push plate slides along the one side of the frame, the fastener rotates along the first push plate;

a shrapnel is provided on an inner side of the frame near the buckle; after the fastener is clamped with the buckle, the shrapnel abuts against the fastener;

wherein the outer end face of the first push plate is further provided with a protrusion, and the one side of the frame is provided with a first through-hole configured to expose the protrusion and a second through-hole configured to expose the fastener; such that by moving the protrusion, the first push plate is controlled to slide left and right within the frame;

wherein the outer end face of the first push plate is provided with a rack, the fastener is provided with a gear, and the gear meshes with the rack; and wherein, when the push plate is pushed, the rack drives the gear to rotate thereby driving the fastener to rotate.

2. The press type assembled fan according to claim 1, wherein the one side of the frame is provided with a first recess, and the other side of the frame is provided with a second recess; the first electrical connector is provided in the first recess, and the second electrical connector is provided in the second recess.

3. The press type assembled fan according to claim 1, wherein one side of the second push plate that protrudes from the frame is provided with a button.

4. The press type assembled fan according to claim 1, wherein an elastic member is connected between the second push plate and the frame.

* * * * *